US006448990B1

(12) United States Patent
Camis et al.

(10) Patent No.: US 6,448,990 B1
(45) **Date of Patent: *Sep. 10, 2002**

(54) TONER PROCESSING SYSTEMS AND ELECTRONIC DISPLAY DEVICES AND METHODS

(75) Inventors: Thomas Camis, Boise, ID (US); Samuel A. Johnson, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/708,361

(22) Filed: Nov. 7, 2000

(51) Int. Cl.[7] ..... B41J 2/385; G03G 13/04; G03G 15/00; G03G 21/10

(52) U.S. Cl. ..... 347/139; 399/108; 399/149; 399/158; 399/357; 399/359

(58) Field of Search ..... 347/139; 399/158, 399/356, 108, 149, 359, 354, 357; 345/864, 169

(56) References Cited

U.S. PATENT DOCUMENTS 4,053,225 A * 10/1977 Morohashi
4,136,943 A * 1/1979 Koizumi ..... 399/158
4,335,955 A * 6/1982 Lopata ..... 399/158
4,355,886 A * 10/1982 Perez et al. ..... 399/356 X
4,448,867 A * 5/1984 Ohkubo et al.
4,465,359 A * 8/1984 Nakahata
4,989,021 A * 1/1991 Ochiai et al. ..... 399/356 X
4,998,141 A * 3/1991 Altmann
5,038,158 A * 8/1991 Ayers et al.
5,065,187 A * 11/1991 Itoh et al. ..... 399/158 X
5,172,164 A * 12/1992 Fujiwara et al. ..... 399/158 X
5,182,601 A * 1/1993 Hodoshima et al.
5,327,256 A * 7/1994 Kang et al.
5,953,564 A * 9/1999 Matsuzoe et al. ..... 399/158

FOREIGN PATENT DOCUMENTS

JP 7-199723 * 8/1995

* cited by examiner

*Primary Examiner*—Susan S. Y. Lee

(57) ABSTRACT

Toner processing systems and electronic display devices and methods are described. In one embodiment, a toner processing system comprises an enclosure and an electrostatic toner recovery assembly supported within the enclosure for electrostatically recovering unfused toner from a print media surface. A toner development assembly is supported within the enclosure proximate the electrostatic toner recovery assembly and is configured to receive recovered toner from the electrostatic toner recovery assembly for reuse on the print media surface.

49 Claims, 6 Drawing Sheets

TONER PROCESSING SYSTEMS AND ELECTRONIC DISPLAY DEVICES AND METHODS

RELATED APPLICATIONS

This application is related to the following U.S. Patent Applications which are owned by the assignee of this document, and filed on the same date as this document, the disclosures of which are incorporated by reference herein:

- U.S. patent application Ser. No. 09/708,936, entitled "Solar Powered Electronic Display Devices and Methods", naming Tom Camis as inventor and bearing Attorney Docket No. 10003282-1;
- U.S patent application Ser. No. 09/708,362, entitled "Hand-held Electronic Display Devices and Methods", naming David Luman, Sam Johnson, and Tom Camis as inventors and bearing Attorney Docket No. 10003281-1;
- U.S. patent application Ser. No. 09/708,335, entitled "Electronic Display Devices and Methods", naming Sam Johnson as inventor and bearing Attorney Docket No. 10003249-1;
- U.S. patent application Ser. No. 09/708,816, entitled "Electronic Display Devices and Methods", naming Tom Camis as inventor and bearing Attorney Docket No. 10003598-1.

TECHNICAL FIELD

This invention pertains to toner processing systems and methods, and display devices that can incorporate such systems and methods.

BACKGROUND

Display devices come in many shapes and sizes and can be implemented using different types of technologies. One particular type of display device is one that enables a user to read various types of materials such as text (e.g. books, magazines, and newspapers) maps, drawings, and the like, while maintaining a desirable degree of portability. For example, in recent times, there has been a push by the industry to provide so-called electronic "readers" so that users might be able to read an electronic version of a favorite book or newspaper.

The design of electronic readers requires an appreciation and consideration of several factors that directly affect the popularity and commercial marketability of the electronic reader. In order to meet the demands of very discriminating consumers, and to provide an economically sensibly-manufactured product, electronic readers should or must: (1) be small enough to be conveniently portable, (2) have a desirable degree of contrast so that the user can easily read content that is displayed by the reader, (3) have a high degree of resolution so that the images displayed by the reader are crisp and clear, (4) have low power consumption characteristics to reduce the overall footprint within the device of the power supply component as well as to provide a desirably long lifetime for a given power supply, and (5) have a low enough cost so that it can be widely available for purchase by many consumers.

There are different technologies that are available for manufacturing various types of display devices among which include CRT (cathode ray tube) technologies, LCD (liquid crystal display) technologies, FEDs (field emission display) technologies, and so called "E-ink" technologies.

CRT technologies are limited, to a large extent, by the contrast that is able to be provided, the size requirements of the displays, the power consumption, resolution and cost. This technology is not a logical choice for conveniently portable electronic readers. LCD technologies typically have complicated electronics and display componentry and do not achieve a desired degree of resolution at a cost that is acceptable to compete in the display reader market. The same can be said of FED technologies.

There is a continuing unmet need for display readers that meet all or some of the criteria discussed above. It would be highly desirable to provide such a display reader that can display content from a number of various sources, such as the Web, a database, a server, and the like, and do so in a manner that satisfies or accommodates the needs of our biological system (i.e. eyes) for resolution, contrast, speed of image generation for reading and the like. Accordingly, the present invention arose out of concerns associated with meeting some or all of these needs.

SUMMARY

Toner processing systems and electronic display devices and methods are described. In one embodiment, a toner processing system comprises an enclosure and an electrostatic toner recovery assembly supported within the enclosure for electrostatically recovering unfused toner from a print media surface. A toner development assembly is supported within the enclosure proximate the electrostatic toner recovery assembly and is configured to receive recovered toner from the electrostatic toner recovery assembly for reuse on the print media surface.

In one particular implementation of a toner processing system, an electronic display device is provided. The display device comprises a housing and a display area within the housing to display content for a user. Memory within the housing holds data that is to be rendered into user-viewable content. An electrophotographic assembly is provided within the housing and is configured to electrophotographically render, with toner, user-viewable content from the data that is held in the memory. A loop of material is disposed proximate the electrophotographic assembly and is configured to receive electrophotographically rendered content and present the content for user viewing within the display area. The loop of material can be advanced by the user in a continual manner so that viewable content is continuously displayed on the loop of material for the user. A toner recovery assembly is positioned proximate, but not physically engaging, the loop of material and is configured to non-invasively recover toner that has been used to render the user-viewable content. The recovered toner can then be reused to render user-viewable content on the loop of material.

DETAILED DESCRIPTION

Exemplary Embodiment Overview

Figure 1:
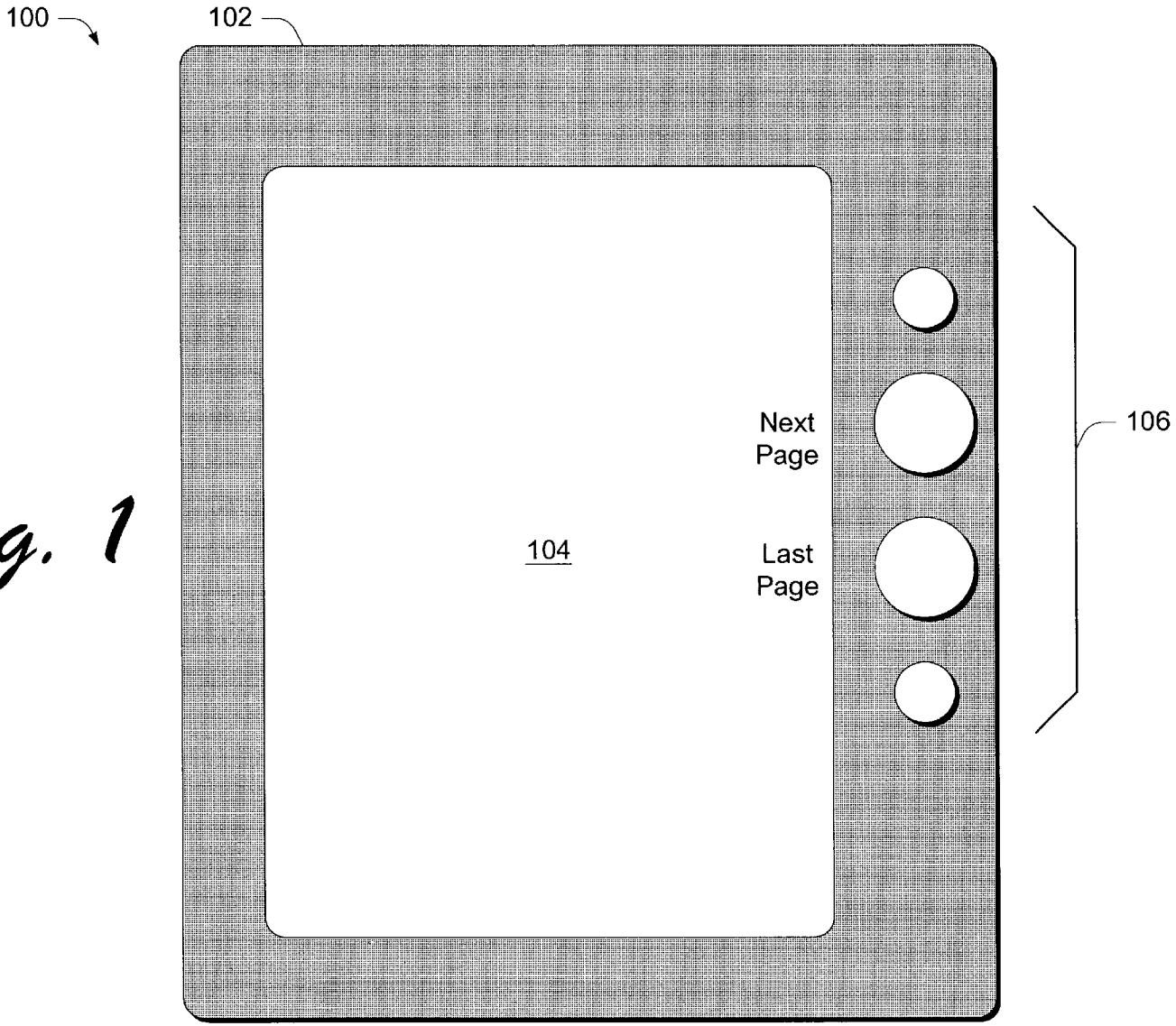
FIG. 1 is a front plan view of an exemplary electronic display device in accordance with the described embodiment.

FIG. 1 shows but one exemplary display reader embodiment generally at 100. Reader 100 comprises a housing 102 that can be formed from any suitable material and can assume any suitable size. In a preferred embodiment, reader 100 is sized to be conveniently portable by the user. Any suitable material can be used for the housing, with an exemplary housing material comprising a hard, durable lightweight plastic material. The housing 102 is configured to provide a display area 104 that is utilized to display content in the form of images that are presented to the user for viewing or reading. A control area 106 is provided and can include one or more user-engagable structures, e.g. buttons or other types of switch components, to permit the user to interact with the reader 100.

In a preferred embodiment, the reader 100 is configured as an electrophotographic printing device that utilizes known electrophotographic techniques to render an image within display area 104. These techniques are discussed in more detail below. The described reader 100 advantageously displays a non-volatile image within the display area 104 and retains the image until it is actively erased or removed. The image, as will become apparent below, does not need to be refreshed after it is rendered, as with other display technologies, so that power consumption, design complexity, and component complexity are desirably reduced. This constitutes a very desired improvement over the other display technologies.

In one particular embodiment, the display area 104 is sized so that it is around 6-inches by 9-inches in dimension, with the overall reader weighing less than about 2 pounds. This provides a viewing area that is generally larger than the viewing area in comparably sized displays that are available on the market. More importantly, the technology that is utilized to provide viewable images within the display area (i.e. electrophotographic technology) is capable of providing images in the range of 300–600 dots-per-inch (dpi) and better. This constitutes a noteworthy advancement over other display readers that provide images at around, or no better than 100 dpi. The higher dpi provided by the described embodiment translates to a higher-quality, clearer, more concise image for the user. Additionally, in one particular embodiment, the media that is utilized to support the image for the reader is selected so that it provides a book-like contrast (i.e. black print on a white page) to give the user an experience that is as close to reading a book as possible, as will become apparent below.

Exemplary Embodiment

Figure 2:
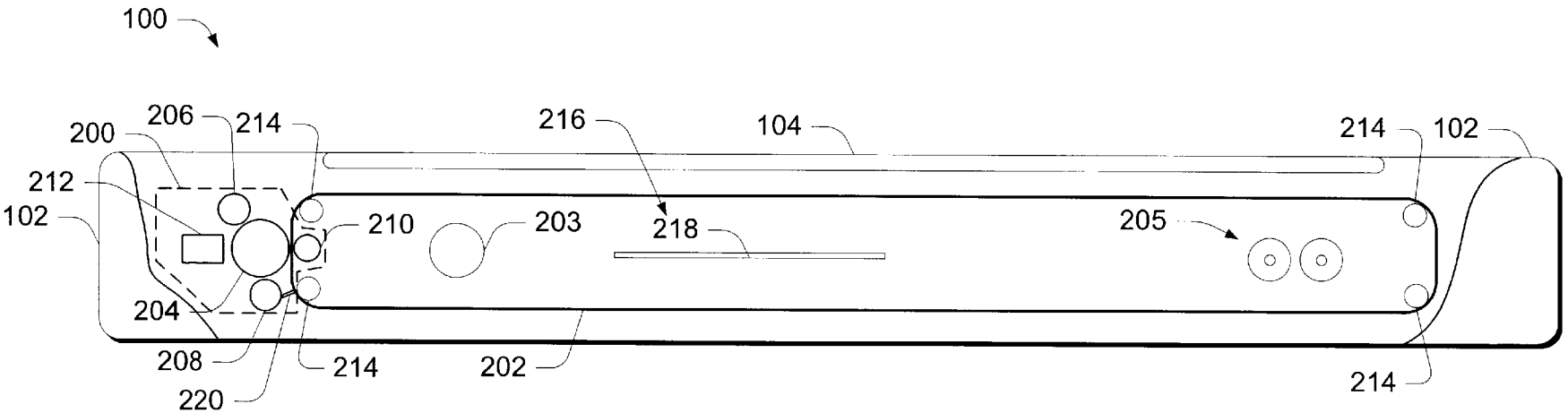
FIG. 2 is a side elevational view of the FIG. 1 device, with a portion removed to show detail.

FIG. 2 is a side view of the FIG. 1 reader with a portion broken away to show detail. In a preferred embodiment, the display reader is configured as an electrophotographic printing device that is similar in operation, in some respects, to a laser printer. Yet, the display reader differs from a laser printer in ways that serve to enhance its utility as a manufactured consumer product.

In the illustrated example, reader 100 includes image processing components that include an electrophotographic assembly 200, and a print media 202. A motor 203 in the form of a small DC permanent magnet motor is provided and, together with a gear train (not shown), cooperates to advance the print media 202 in a manner such that it can be viewed in the display area 104. The DC motor 203 is powered by a suitable power source 205 which, in this example, comprises a pair of standard AA batteries. It will be appreciated that other power sources could be used. One exemplary power source which can be used is a solar power source that can be used instead of, or in addition to the battery power source.

The electrophotographic assembly 200 can comprise any suitable electrophotographic assembly that is capable of providing non-volatile images onto the print media 202. In the described example, the assembly 200 comprises an optical photoconductor (OPC) 204 in the form of a rotatable drum that is similar in construction and operation to OPCs that are commonly employed in laser printers. A charge roller 206 and developer roller 208 are provided in operable proximity to the OPC 204. The developer roller is magnetic in nature and magnetically retains toner thereon, as will be appreciated by those of skill in the art. A transfer roller 210 is provided as shown and functions to transfer toner from the OPC to the print media in a conventional manner. A source of focused light energy is provided for exposing selected areas of the OPC. In this example, the source of light energy comprises a LED bar 212 that is configured as a 1-dimensional linear array scanning element. Other sources of focused light energy can, however, be utilized. For example, an optical scanning laser having rotatable polygons and beam modulators could be utilized. The reader will appreciate that any suitable toner that can be utilized in electrophotographic processes can be utilized in the presently-described embodiment. Preferably, the toner that is utilized has magnetic properties that permit its use in the described process, as will be understood by those of skill in the art.

Print media 202 is provided, in this example, as a continuous loop of material that is formed from a suitable dielectric material for purposes that will become evident. Exemplary materials are polyurethane and/or similar materials having the appropriate mechanical and electrical characteristics. The physical, electrical and optical characteristics of the toner-carrying loop of material are as follows. First, the loop of material has to function as toner transport system that also acts as the image viewing background. This requires mechanical integrity and strength so the loop of material will not stretch or tear, and is easy to track. In order to get adequate optical contrast between the black toner and the material loop there should also be a thin white (or light colored) over coating to provide this contrast. Therefore, the loop is constructed as an endless, two-layered structure. The uppermost layer is a relatively thin, smooth dielectric material (e.g. 0.00254 cm–0.00381 cm). This uppermost toner-supporting layer is preferred to be electrically non-conductive (e.g. volume resistivity >10^10 ohm-cm) and desirably has good surface charge retention characteristics to help retain toner on the surface. The underlayer is an elastomeric material that is electrically conductive (10^4 ohm-cm–10^7 ohm-cm) at a thickness of about (0.1 cm–0.15 cm).

The print media can have any suitable dimension that facilitates the portability of the overall reader. In one embodiment, the print media is dimensioned to be about 6-inches in width. This width gives the appearance of a page of a book.

In the illustrated example, print media 202 is supported by multiple idler rollers 214. Four exemplary idler rollers are used in this example. The idler rollers are spaced to accommodate an internal area 216 within which a printed circuit assembly 218, motor 203, power source 205 and a portion of the electrophotographic assembly are contained. The printed circuit assembly 218 contains the hardware and firmware that is utilized to implement the reader 100.

Exemplary Display Reader System

Figure 3:
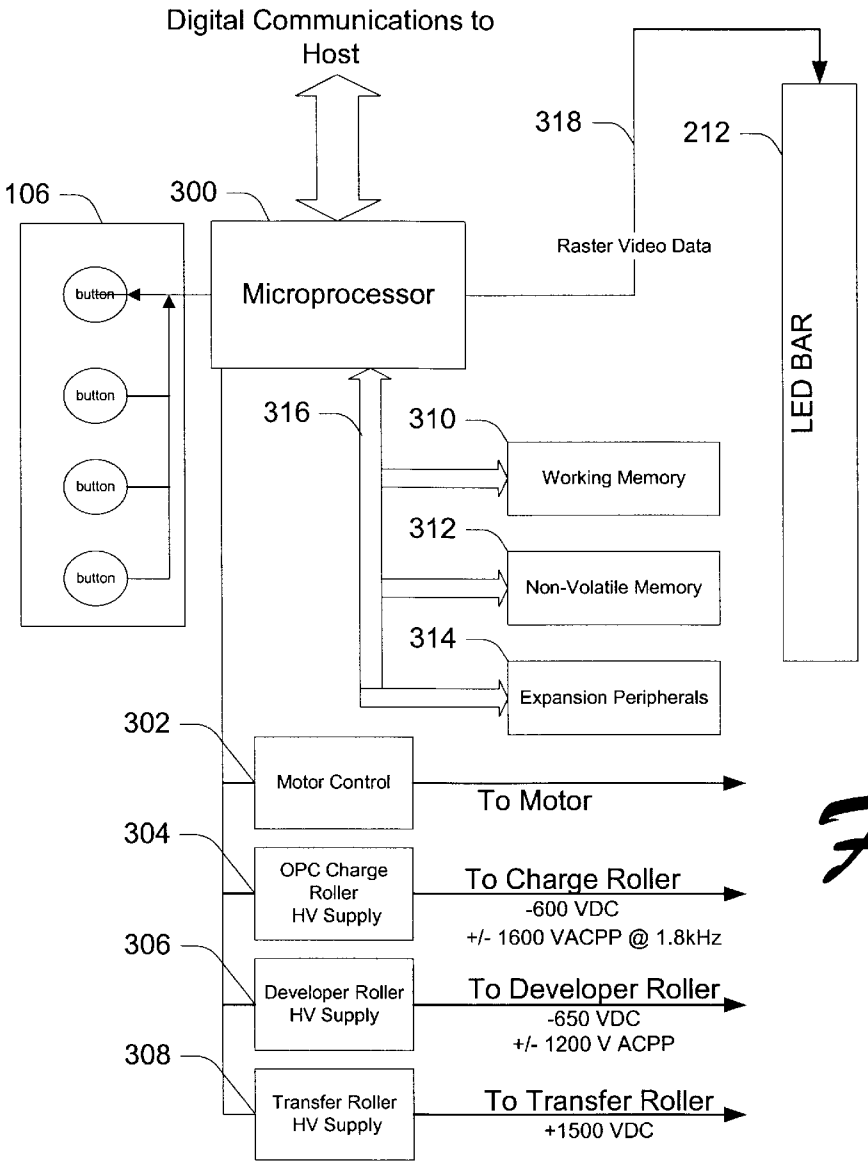
FIG. 3 is a diagram of an exemplary display device system.

FIG. 3 shows a diagram that includes various components of an exemplary display reader to assist in understanding how the described embodiment works. Some of these components are supported on the printed circuit assembly 218 (FIG. 2). The system uses, in a preferred embodiment, known rasterization techniques to render images for user viewing.

The illustrated and described display reader includes a microprocessor 300 that is operably coupled to a user interface that is provided within control area 106. The display reader also includes a motor control 302, OPC charge roller high voltage supply 304, developer roller high voltage supply 306 and transfer roller high voltage supply 308. The operation of these components are known and are not described in any more detail here. The display reader also includes working memory 310, non-volatile memory 312, expansion peripherals 314 and a bus 316 that operably connects these components to the microprocessor 300. The expansion peripherals component 314 is provided to accommodate additional peripherals that might be added to the unit (e.g. wireless modem/adapter, cell modem, CD ROM drive, and the like.

Working memory 310 can be any suitable memory such as RAM, SDRAM, and the like. This memory space is used to build pre-rasterized image maps which are computed prior to printing the next page. Additional rasterized pages, such as the current page, the next page, and previous few pages can be retained in the working memory 310 for fast retrieval and printing upon user demand. Firmware code can also be resident in a certain portion of this memory. The firmware code can be copied at power-up from a segment of non-volatile memory 312. This has advantages of downloading upgraded code for enhanced used features.

Nonvolatile memory 312 can be any suitable non-volatile memory such as Flash, Ferro-electric, battery backed EDO RAM, and the like. This memory is used to retain downloaded data content (such as books, magazines, newspapers, graphics, etc) that is to be rendered for view by the user. In this particular described implementation, roughly 1000 printed pages per megabyte of ASCII text can be stored with compression. Accordingly, 8 MB of memory would store about 8000 pages of text. This is the equivalent of dozens of novels, books, etc. The microprocessor operates on the ASCII/graphics data to rasterize it according to pre-built font maps, scalable font algorithms, bit-maps, etc., and creates a virtual image in DRAM. Using a low power microprocessor, this operation can take one or two seconds, thereby giving the user a virtually instant response to pushing a next page button. The data could also be pre-rasterized first. Thus, all that is required is to stream the video bit-map (compressed or uncompressed) to a Video Raster Data Line 318 which loads the LED array 212. Not shown in this illustration, but understood by those of skill in the art, is a strobe data line which latches the entire Video Raster Data Line into the LED buffer, causing the appropriate LED to fire.

The microprocessor 300 is configured to receive digital data or information from a host system. Content can be provided to the display reader through any suitable communication port/technique. For example, content can be downloaded from a user's host PC that is connected to the web. This content might be procured through some type of electronic business transaction whereby a user purchases content on line for later reading. In a preferred embodiment, data is downloaded using a USB (Universal Serial Bus). Other techniques or technologies can, of course, be used. Exemplary techniques include, without limitation, IR (Infrared), BlueTooth, RF (Radio Frequency), or any of a variety of other techniques that enable data to be received and/or provided by the display reader.

Soft Menu Item Feature

In one preferred embodiment, a so-called soft menu item feature is provided. Referring back to FIG. 1, the largest of the control buttons appearing in the control area 106 are seen to each be associated with a menu item that is presented within the display area. For example, the top most large control button is associated with a "Last Page" menu item and the bottom most large control button is associated with a "Next Page" menu item. These menu items are rendered directly onto the print media through the electrophotographic process and are aligned with the appropriate control buttons. Thus, with each new page, a set of soft menu items can be rendered and aligned with the control buttons. This is a feature that provides a desired degree of flexibility in that the soft menu items can be programmatically changed by changing the software that renders the menu items and controls their functionality.

In Operation

In operation, the described display reader provides a conveniently portable, handheld device that can be utilized to view content or text at the user's convenience. The content can be acquired by the device in any suitable manner. For example, as was mentioned above, a user might download content purchased from the Internet so that they can later view the content. The content, e.g. books and the like, would be saved in digital form in the memory of the display reader. The user, by manipulating the structures within control area 106 (e.g. next page, last page, zoom in, zoom out etc.), can then read or view the content that is resident on the display reader.

The images that are formed on the print media 202 are formed through the use of conventional rasterization techniques which will be understood by those of skill in the art. Accordingly, those techniques are not discussed in any detail here. However, for background information on suitable rasterization techniques, the reader is referred to the following U.S. Patents which are assigned to the assignee of this document, the disclosures of which are incorporated by reference herein: U.S. Pat. Nos. 6,037,962, 5,854,866, 5,490,237, 5,479,587, and 5,483,622.

In the illustrated and described embodiment, and with reference to FIG. 2, the print media 202 is advanced in a clockwise direction (as viewed in the figure) so that a user can view images that are developed onto the print media. The user can control the scrolling process as well as various display characteristics of the displayed image through the use of the buttons provided within the control area of the housing. The process of image formation is similar, in some respects, to the process by which an image is formed on a print media, e.g. paper, within a laser printer (including the rasterization techniques mentioned above). One noteworthy difference, however, is that the toner that is utilized in the presently-described embodiment is never fused onto the print media. Rather, the toner is held in place only by electrostatic forces which permit the toner to be reclaimed for further use.

More specifically, the optical photoconductor 204 is first charged by charge roller 206. Other techniques however, such as ion transport or a variety of other mechanisms can be used to charge the charge roller 206, as will be appreciated by those of skill in the art. Once the OPC 204 is charged, selected regions of the OPC are discharged by exposing the regions to focused light energy in a conventional manner. Exposure of the OPC takes place using the raster data that is provided by microprocessor 300 (FIG. 3). In the present example, LED bar 212 is utilized to discharge the selected areas of the OPC 204. This process forms an intermediary image on the OPC 204 that is to eventually appear on the print media 202. The intermediary image is then developed.

In the described embodiment, the development process involves the transport of toner particles (e.g. small electrostatically charged particles) into close proximity with the OPC's intermediary image or latent image. The intent of the development process is to allow the toner particles to be attracted to the discharged portions of the OPC 204. There are a variety of development technologies that can be utilized to effect the development process, as will be apparent to those of skill in the art. For example, so called discharge-area-development "DAD" "jump-gap" technology can be utilized. This technology transfers toner by bringing it into close proximity to, but not into direct contact with the OPC 204. An AC and DC electrical bias arrangement is then used to "project" the toner particles over the physical distance between the developer roller 208 and the OPC 204. Alternately, so-called "contact" technologies can be used to develop the image on the OPC 204. In contact technologies, the toner particles are brought into direct physical contact with the OPC 204 where transfer is accomplished similarly, as will be appreciated by those of skill in the art. Various suitable toner development technologies are discussed in the following U.S. Patents, assigned to the assignee of this document, the disclosures of which are incorporated by reference: U.S. Pat. Nos. 5,991,589 and 5,799,230.

Once the toner has been developed onto the OPC, the image on the OPC is transferred to the print media 202. In the described embodiment, this is effectuated through the use of transfer roller 210 that is positioned on the backside of the print media. The transfer roller attracts the toner off of the OPC 204 and onto the print media in a conventional electrostatic manner. As the print media advances in the clockwise direction, the images that it supports (such as text) can be viewed by the user. The user can view and manipulate these images by manipulating the engagable structures within the control area 106. As the print media advances, the above-described process is repeated for serially presenting content such as the text that one might find on the pages of a book or magazine.

Toner Reclaim

As the media-carried toner returns to the electrophotographic assembly 200, the toner that resides on the media is reclaimed for additional use. In the presently-illustrated example, a wiper blade mechanism 220 is provided and physically engages the print media as the media passes. The wiper blade mechanism can be constructed from any suitable material, with an exemplary material comprising silicone. The toner can also be re-claimed through electrostatic techniques that are described in the section entitled "Electrostatic Toner Reclamation" directly below. The toner is then re-attracted to the developer roller 208 by virtue of its reversed electrostatic field forces that are provided by the DC and AC electrical biasing in a manner that will be appreciated by those of skill in the art. The OPC development process and image formation process described above can then be repeated.

Electrostatic Toner Reclamation

Figure 4:
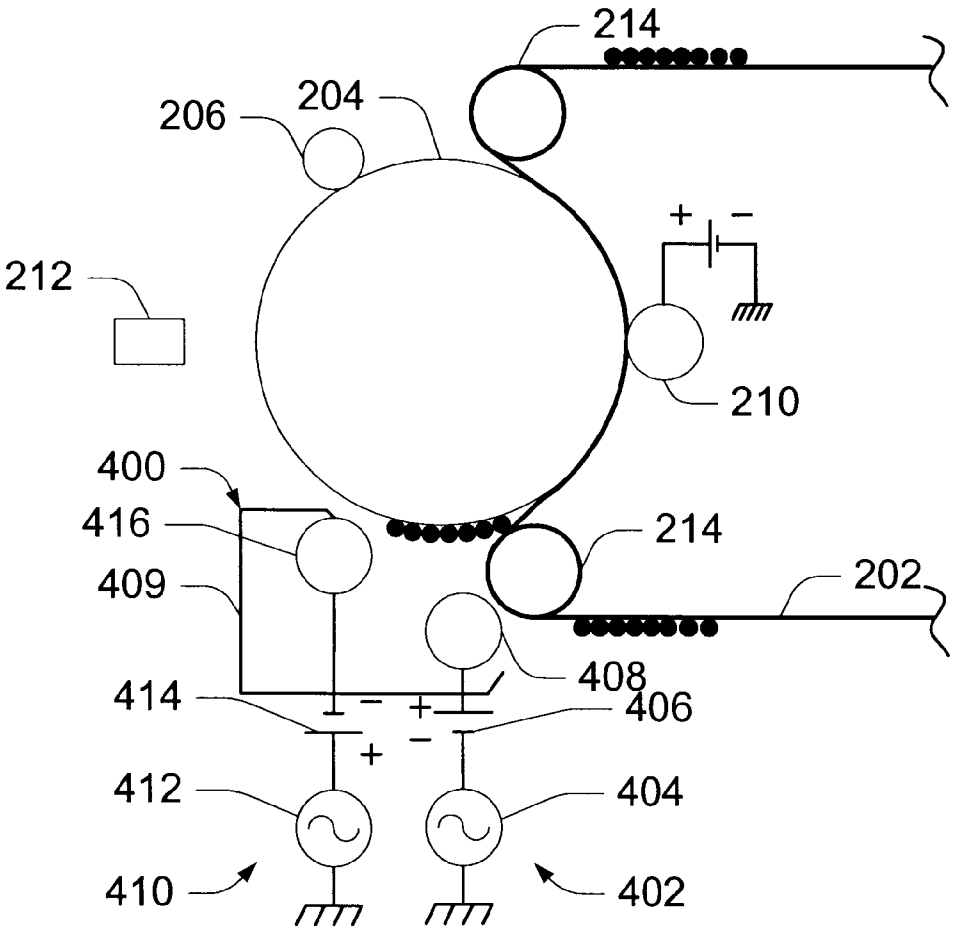
FIG. 4 is a view of a toner processing system in accordance with the described embodiment, being employed in connection with an electrophotographic printing assembly.

FIG. 4 shows exemplary components of the FIG. 2 embodiment. This embodiment, however, includes an electrostatic toner reclaim mechanism that replaces blade 220 (FIG. 2) and non-invasively recovers or reclaims toner that has been applied to loop of material 202. By non-invasively recovering the toner through the use of electrostatic forces, the battery lifetimes can be increased because there are somewhat higher drag forces attributable to invasive recovery systems (such as the silicone blade) that must be overcome. Additionally, the lifetime of the loop of material 202 can be increased because any friction or contact-induced damage to the material attributable to an invasive recovery mechanism like blade 220 is mitigated by the electrostatic recovery mechanism.

In the illustrated and described embodiment, a toner recovery assembly 400 includes an electrostatic toner recovery mechanism 402. In this particular example, toner recovery mechanism 402 includes an AC voltage source 404, a DC voltage source 406, and a toner recovery roller 408 that is magnetic in nature, as will be understood by those of skill in the art. As the toner returns to the toner recovery assembly 400 on loop of material 202, the toner particles, which are negatively charged in this example, are attracted to the recovery roller 408 by virtue of an opposite bias (e.g. positive DC bias) that is applied to the recovery roller. The AC voltage source creates a "cloud" within which the recovered toner moves, as will be understood by those of skill in the art. The toner particles are recovered and collected within an enclosure 409. Once the toner particles are non-invasively recovered, they can be recycled for use. In this particular example, the toner recovery assembly 400 includes a development assembly 410 within enclosure 409 that uses the recovered toner particles and reapplies them on OPC 204.

Figure 5:
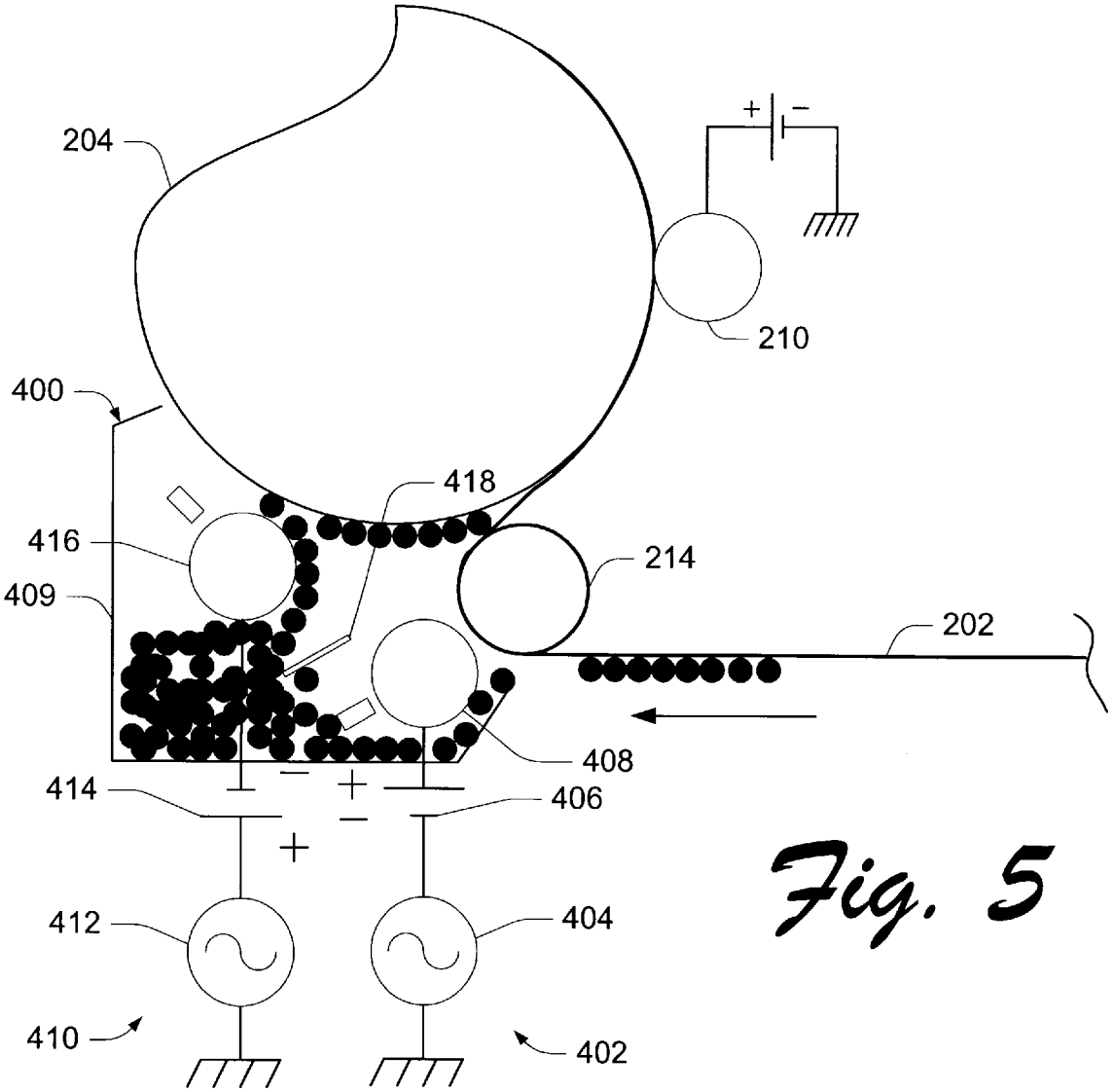
FIG. 5 is a view of the FIG. 4 toner processing system which shows more detail.

FIG. 5 shows the toner recovery system 400 in more detail. There, development assembly 410 includes an AC voltage source 412, a DC voltage source 414 and a toner development roller 416 that is magnetic in nature, as will be understood by those of skill in the art. An auger or paddle-wheel mechanism 418 is provided and mechanically redistributes toner that is recovered by the toner recovery mechanism 402 so that it is provided in the vicinity of the development assembly 410. Once the toner is in the vicinity of the development assembly 410, the toner is magnetically attracted to the development roller 416 and then electrostatically applied or re-applied to selected exposed regions of the OPC 204. Specifically, in this example, the negatively charged toner particles are, once in operable proximity with the development roller 416, subjected to a negative DC bias which effectively pushes the toner particles from the developer roller 416 toward the selected exposed regions of the OPC 204, thus developing a latent image onto the OPC which can then be transferred to the loop of material 202 as described above.

Preferably, the toner recovery system 400 is an integrated unit having both a toner recovery mechanism 402 and a development assembly 410 for reusing the recovered toner. It will be understood and appreciated that the described integrated unit can be implemented in connection with other printing systems that are different from the described reader display. The reader display simply constitutes but one exemplary implementation of a toner recovery system.

Toner

In the illustrated and described embodiment, any suitable toner that is typically used in conventional electrophotographic applications can be utilized. In some implementations, it would be particularly advantageous to utilize a toner that is spherical in nature with the toner particles having a diameter in the range of 5–15 microns. Such toner should be "hard" as contrasted with the typically "soft" fusible toner that is utilized in electrophotographic fusing operations. By using a hard toner with particles dimensioned as described, developing voltages and power requirements can be reduced. Additionally, a hard spherical toner would be advantageous in that it would be robust and resist degradation during toner reclaim operations.

Exemplary Method

Figure 6:
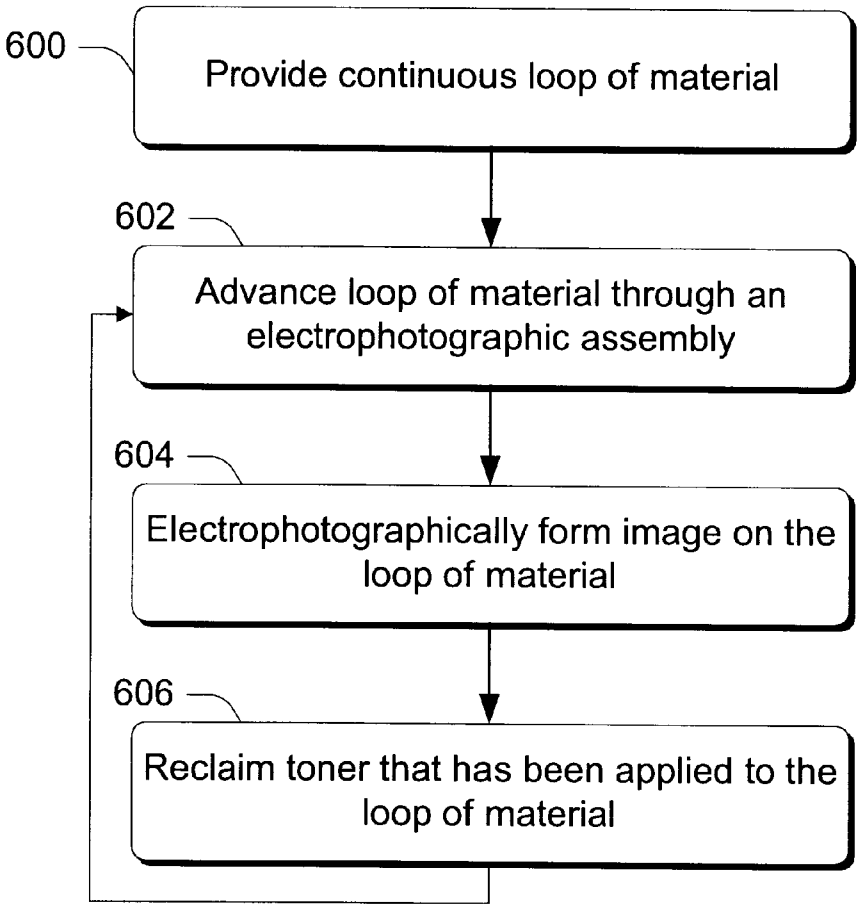
FIG. 6 is a flow diagram that describes steps in a method in accordance with the described embodiment.

FIG. 6 is a flow diagram that describes steps in a method in accordance with the described embodiment. The steps described below can be implemented using a reader device such as the one that is described above.

Step 600 provides a continuous loop of material upon which an image is to be formed. Exemplary materials are described above. Step 602 advances the loop of material through an electrophotographic assembly that is configured to electrophotographically form an image on the loop of material. Step 604 electrophotographically forms an image on the loop of material by applying non-fused toner to the loop of material. The image is then advanced into a display area so that the user can view the image. Step 606 reclaims toner that has been applied to the loop of material and returns to step 602 to reuse toner that has been previously reclaimed. Reclamation or recovery of toner can take place mechanically through invasive techniques, as by use of the exemplary blade described above. Alternately and more preferred, reclamation or recovery can take place through non-invasive techniques, as by the exemplary electrostatic recovery technique described above.

The embodiments described above are different from other approaches that have been attempted in the past. These differences accentuate the advantages that the presently-described embodiment provides.

First, the described approach is different from the approaches that are typically taken by a laser printer in that the toner is not fused to the print media. This reduces the complexity and cost of the design because fusing components are not necessary. Additionally, because the toner is not permanently applied to the print media, it can be reclaimed for use. This can add to the useful life of the device.

Additionally, the inventors are not aware of any portable reader devices that utilize a continuous loop of material as the print media. The continuous nature of the loop of material is advantageous because it can be reused over and over again, thus effectively increasing the lifetime of the reader. The reader construction is thus essentially self-contained and does not have to have any of the components replaced for further operation.

Further, the use of OPC 204 in combination with the preferred print media is advantageous in that it does not require the use of harmful or volatile materials and provides a reusable material with a book-like contrast quality. For example, there are print devices that utilize a print media that is coated with cadmium sulfide which is a toxic material. In addition to its toxicity, cadmium sulfide is not a desirable material to use because it is yellow in color and does not provide a desirable degree of contrast when viewed.

Conclusion

The various embodiments described above provide a low cost display device that is sized so that it is conveniently portable. A desirable degree of contrast is provided through the use of an electrophotographic image-forming process that utilizes a print media in the form of a loop of material that is selected so that it provides a black/white contrast when used in connection with black toner. Resolutions can be attained that are at least 300 dpi and better, thereby providing the user with a book-like experience when the device is used to read text. The device has low power consumption characteristics owing at least in part to the electrophotographic process that is utilized to provide the viewable images. Power savings are enhanced and material wear is reduced though the use, in some embodiments, of an electrostatic toner recovery system which is non-invasive in nature. The device is only required to consume power when a new image is being rendered and advanced into the device's viewing area. Consequently, the equivalent of many novels can be read by a user without having to replace the power source.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An electronic display device comprising:

a housing;

a display area provided within the housing to display content for a user;

memory within the housing to hold data that is to be rendered into user-viewable content;

an electrophotographic assembly within the housing configured to electrophotographically render, with toner, user-viewable content from the data that is held in the memory;

an amount of material disposed proximate the electrophotographic assembly and configured to receive electrophotographically rendered content and present the content for user viewing within the display area; and a toner recovery assembly positioned proximate, but not physically engaging, the amount of material and configured recover toner that has been used to render the user-viewable content;

said display device being configured as an electronic reader and having a size and weight that makes the device conveniently portable for the user;

the device further being configured to permit operation as a reader while the device is being carried by the user.

2. The electronic display device of claim 1, wherein said amount of material comprises a loop of material.

3. The electronic display device of claim 1, wherein the toner recovery assembly comprises an electrostatic mechanism.

4. The electronic display device of claim 1, wherein the toner recovery assembly comprises an electrically-biasable toner recovery roller.

5. The electronic display device of claim 4 further comprising one or more voltage sources configured to bias the toner recovery roller.

6. The electronic display device of claim 1 further comprising a toner development roller positioned proximate the toner recovery assembly and the electrophotographic assembly and configured to recycle recovered toner.

7. A toner processing system comprising:

an enclosure;

an electrostatic toner recovery assembly supported within the enclosure for electrostatically recovering unfused toner from a print media surface; and a toner development assembly supported within the enclosure proximate the electrostatic toner recovery assembly and configured to receive recovered toner from the electrostatic toner recovery assembly for reuse on a print media surface;

the system having a size and weight that permits the system to be carried by a user;

the system further being configured for operation while the system is being carried by the user.

8. The toner processing system of claim 7, wherein the electrostatic toner recovery assembly comprises an electrically-biasable toner recovery roller.

9. The toner processing system of claim 8 further comprising one or more voltage sources configured to bias the electrically-biasable toner recovery roller.

10. The toner processing system of claim 7, wherein the toner development assembly comprises an electrically-biasable toner development roller.

11. The toner processing system of claim 7, wherein:

the electrostatic toner recovery assembly comprises an electrically-biasable toner recovery roller; and the toner development assembly comprises an electrically-biasable toner development roller.

12. The toner processing system of claim 7 further comprising an optical photoconductor positioned proximate the enclosure and configured to receive recovered toner from the toner development assembly.

13. The toner processing system of claim 12 further comprising a loop of material disposed proximate the optical photoconductor and configured to receive toner therefrom for presentation of user-viewable content.

14. A printing system embodying the toner processing system of claim 7.

15. A battery-operated printing system embodying the toner processing system of claim 7.

16. A portable, battery-operated printing system embodying the toner processing system of claim 7.

17. An electronic display device comprising:

a housing;

a display area provided within the housing to display content for a user;

memory within the housing to hold data that is to be rendered into user-viewable content;

a control area on the housing comprising one or more user-engagable structures to permit the user to interact with the device;

an electrophotographic assembly within the housing configured to electrophotographically render user-viewable content from the data that is held in the memory, the electrophotographic assembly comprising:

an optical photoconductor drum;

a charge mechanism to charge the optical photoconductor drum;

a source of light energy to expose selected areas on the optical photoconductor drum;

a developer mechanism to provide toner onto the optical photoconductor drum; and a transfer mechanism to effect transfer of the toner from the optical photoconductor to a print medium;

a print medium comprising a loop of material a portion of which being disposed intermediate the optical photoconductor and the transfer mechanism and configured to receive electrophotographically rendered content and present the content for user viewing within the display area;

a toner recovery assembly positioned proximate, but not physically engaging, the loop of material and configured to recover toner that has been used to render the user-viewable content; and a motor operably coupled with the print medium and configured to move the print medium within the display area responsive to a user engaging the user-engagable structures within the control area;

the electronic display device having a size and weight that makes the device conveniently portable for the user;

the electronic display device further being configured for operation while the device is being carried by the user.

18. The electronic display device of claim 17, wherein the toner recovery assembly comprises an electrostatic mechanism.

19. The electronic display device of claim 17, wherein the toner recovery assembly comprises an electrically-biasable toner recovery roller.

20. The electronic display device of claim 17, wherein the print medium is configured to provide a black/white contrast when used in connection with black toner.

21. The electronic display device of claim 17, wherein the electrophotographic assembly is configured to render the user-viewable content at 300 dpi or better.

22. The electronic display device of claim 17, wherein the electrophotographic assembly is configured to render the user-viewable content at at least 600 dpi.

23. The electronic display device of claim 17, wherein the electrophotographic assembly is configured to render the user-viewable content at between 300 dpi to 600 dpi inclusive.

24. The electronic display device of claim 17, wherein the device is battery powered.

25. The electronic display device of claim 17, wherein the device is portable.

26. A method of displaying images comprising:

providing a hand-held, portable display device comprising an electrophotographic assembly configured to electrophotographically render user-viewable content, and a loop of material proximate the electrophotographic assembly to receive content that is electrophotographically rendered with unfused toner and present the content to a user for viewing;

advancing the loop of material through the electrophotographic assembly;

electrophotographically forming an image on the loop of material;

displaying the image for the user to view; and after displaying the image for the user, recovering unfused toner from the loop of material;

said display device being configured to permit said acts of advancing, forming, displaying and recovering to be performed while the display device is being carried by the user.

27. The method of claim 26, wherein said recovering comprises electrostatically doing so.

28. The method of claim 26, wherein said recovering comprises electrostatically doing so with an electrically-biasable toner recovery roller.

29. The method of claim 26 further comprising reusing recovered unfused toner to electrophotographically form additional images on the loop of material.

30. A method of displaying images comprising:

moving a loop of material through an electrophotographic assembly that comprises part of a portable display reader;

electrostatically attracting toner onto the loop of material using the electrophotographic assembly sufficient to provide a viewable image;

non-invasively reclaiming the toner that was attracted onto the loop of material; and reusing at least some reclaimed toner;

said portable display reader being configured to permit said acts of moving, attracting, reclaiming and reusing to be performed while the display reader is being carried by a user.

31. The method of claim 30, wherein the reclaiming of the toner comprises doing so using an electrically-biasable mechanism.

32. The method of claim 30, wherein the reclaiming of the toner comprises doing so using an electrically-biasable toner recovery roller.

33. The electronic display device of claim 1, wherein the device weighs less than about 2 pounds.

34. A printing system embodying the toner processing system of claim 7 and weighing less than about 2 pounds.

35. A battery-operated printing system embodying the toner processing system of claim 7 and weighing less than about 2 pounds.

36. A portable, battery-operated printing system embodying the toner processing system of claim 7 and weighing less than about 2 pounds.

37. The electronic display device of claim 17, wherein the device weighs less than about 2 pounds.

38. An electronic display device comprising:

a housing;

a display area provided within the housing to display content for a user;

memory within the housing to hold data that is to be rendered into user-viewable content;

an electrophotographic assembly within the housing configured to electrophotographically render, with toner, user-viewable content from the data that is held in the memory and at at least 600 dpi;

an amount of material disposed proximate the electrophotographic assembly and configured to receive electrophotographically rendered content and present the content for user viewing within the display area; and a toner recovery assembly positioned proximate, but not physically engaging, the amount of material and configured recover toner that has been used to render the user-viewable content.

39. The electronic display device of claim 38, wherein said amount of material comprises a loop of material.

40. The electronic display device of claim 38, wherein the toner recovery assembly comprises an electrostatic mechanism.

41. The electronic display device of claim 38, wherein the toner recovery assembly comprises an electrically-biasable toner recovery roller.

42. The electronic display device of claim 41 further comprising one or more voltage sources configured to bias the toner recovery roller.

43. The electronic display device of claim 38 further comprising a toner development roller positioned proximate the toner recovery assembly and the electrophotographic assembly and configured to recycle recovered toner.

44. An electronic display device comprising:

a housing;

a display area provided within the housing to display content for a user;

memory within the housing to hold data that is to be rendered into user-viewable content;

a control area on the housing comprising one or more user-engagable structures to permit the user to interact with the device;

an electrophotographic assembly within the housing configured to electrophotographically render user-viewable content from the data that is held in the memory, the electrophotographic assembly being configured to render the user-viewable content at at least 600 dpi and comprising:

an optical photoconductor drum;

a charge mechanism to charge the optical photoconductor drum;

a source of light energy to expose selected areas on the optical photoconductor drum;

a developer mechanism to provide toner onto the optical photoconductor drum; and a transfer mechanism to effect transfer of the toner from the optical photoconductor to a print medium;

a print medium comprising a loop of material a portion of which being disposed intermediate the optical photoconductor and the transfer mechanism and configured to receive electrophotographically rendered content and present the content for user viewing within the display area;

a toner recovery assembly positioned proximate, but not physically engaging, the loop of material and configured to recover toner that has been used to render the user-viewable content; and a motor operably coupled with the print medium and configured to move the print medium within the display area responsive to a user engaging the user-engagable structures within the control area.

45. The electronic display device of claim 44, wherein the toner recovery assembly comprises an electrostatic mechanism.

46. The electronic display device of claim 44, wherein the toner recovery assembly comprises an electrically-biasable toner recovery roller.

47. The electronic display device of claim 44, wherein the print medium is configured to provide a black/white contrast when used in connection with black toner.

48. The electronic display device of claim 44, wherein the device is battery powered.

49. The electronic display device of claim 44, wherein the device is portable.

* * * * *